US007556905B2

(12) United States Patent
Yoshida et al.

(10) Patent No.: US 7,556,905 B2
(45) Date of Patent: Jul. 7, 2009

(54) ELECTROSTATIC CHARGE IMAGE DEVELOPING TONER

(75) Inventors: Eiichi Yoshida, Tokyo (JP); Masahiko Nakamura, Tokyo (JP); Kaori Soeda, Tokyo (JP); Tomoko Mine, Tokyo (JP); Kenichi Onaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 252 days.

(21) Appl. No.: 11/562,006

(22) Filed: Nov. 21, 2006

(65) Prior Publication Data

US 2007/0148578 A1 Jun. 28, 2007

(30) Foreign Application Priority Data

Dec. 27, 2005 (JP) ..... 2005-374597

(51) Int. Cl.
*G03G 9/00* (2006.01)

(52) U.S. Cl. ..... 430/108.4; 430/109.3

(58) Field of Classification Search ..... 430/108.4, 430/109.3

See application file for complete search history.

(56) References Cited

U.S. PATENT DOCUMENTS

| | | | | |
|---|---|---|---|---|
| 4,469,770 | A * | 9/1984 | Nelson | 430/108.4 |
| 5,928,831 | A | 7/1999 | Nakamura | |
| 6,171,743 | B1 | 1/2001 | Nakamura | |
| 2004/0058262 | A1 * | 3/2004 | Serizawa et al. | 430/108.4 |
| 2007/0020541 | A1 * | 1/2007 | Hasegawa et al. | 430/106.1 |

FOREIGN PATENT DOCUMENTS

| | | | |
|---|---|---|---|
| EP | 0881545 | A1 | 12/1998 |
| EP | 1539192 | A1 | 5/2005 |

* cited by examiner

*Primary Examiner*—John L Goodrow
(74) *Attorney, Agent, or Firm*—Lucas & Mercanti, LLP

(57) ABSTRACT

Provided is an electrostatic charge image developing toner usable for downsized color image forming apparatus capable of rapid print preparation with neither an influence on production cost nor use of a specific material as the toner constituent material. Also disclosed is an electrostatic charge image developing toner possessing at least a resin and a colorant, wherein the electrostatic charge image developing toner contains 12-984 ppm of a polyvalent organic acid or a salt thereof.

10 Claims, 2 Drawing Sheets

ELECTROSTATIC CHARGE IMAGE DEVELOPING TONER

TECHNICAL FIELD

The present invention relates to an electrostatic charge image developing toner used for electrophotographic image formation.

BACKGROUND

It is seen that the demand of color image formation obtained by an electrophotographic image forming apparatus typified by a laser printer or MFP (a multifunction printer; a multifunction complex printer) is further expanding. An image forming apparatus employing a single component developer, which is capable of forming an image without using a carrier, is mainly employed as a color image forming apparatus to satisfy this demand, since the downsizing and maintenance are also desired in order to spread the foregoing. As the image forming method employing a single component developer, known is a method in which a latent image formed on an electrostatic latent image carrier is transported by a developer carrier such as a developing roller, and developed by a single component developer made of a supplied toner, and the formed toner image is subsequently transferred into a transfer material to thermally fix the toner image on the transfer material.

From the viewpoint of recent toner technology trend, the development of a so-called polymerization toner prepared via a process of coagulating resin particles in an aqueous medium has actively been done. The polymerization toner is suitable for preparing particles having a small particle diameter accompanied with similar particle shape and size in the manufacturing process, and is capable of being a most suitable toner to form a pictorial image (refer to Patent Document 1, for example).

Meanwhile, with downsizing of an image forming apparatus, a downsized developing device is also to be used, whereby crushing of toner in the developing device is of particular concern since the downsized developing device gives toner a strong impact from a stirring member and a film formation member. Fine powder generated via crushing of toner adheres to the surface of a developing roller, and filming which causes scattering of toner is induced. Consequently, as a technique aiming at prevention of crushing a single component toner, there is a technique in which toner having a softening point, particle hardness and average circularity which have been identified is produced via particle formation in an aqueous medium, for example (refer to Patent Document 2, for example).

In the case of acquiring a toner constituent material to satisfy these conditions at the same time, however, kinds of a resin and so forth are to be limited, resulting in an influence on toner production cost.

Rapid full color image formation used for preparation of a conference material at the office and POP advertisement tends also to be demanded. In the case of conducting high-speed printing with a downsized color printer, rapid and stable charge rising capability is desired for toner. As a technique corresponding to this demand, there is a technique capable of enabling the rapid charge rising, by using toner made of a polyester resin, a colorant, a charge control agent or oxidation type polyolefin wax, which is prepared via kneading and crushing processes, for example (refer to Patent Document 3, for example).

However, the constituent material of the toner disclosed in above-described Patent Document 3 is also limited, and an influence on the toner production cost can not be neglected. There was also a tendency to reduce image density gradually via charging during continuous printing.

As a technique aiming at prevention of density reduction caused by continuous printing, there is a technique in which a small diameter toner having a sharp particle size distribution can be acquired by stabilizing liquid droplets of a monomer composition in an aqueous suspension medium via preparation of a polymerization toner by combining a positive charge control resin with a negative charge control resin, for example (refer to Patent Document 4, for example).

However, the influence on toner production cost could not be ignored, since the charge control resin was a specific resin in this technique.

[Patent Document 1] Japanese Patent O.P.I. Publication No. 2000-214629

[Patent Document 2] Japanese Patent O.P.I. Publication No. 2004-46117

[Patent Document 3] Japanese Patent O.P.I. Publication No. 2000-235280

[Patent Document 4] Japanese Patent O.P.I. Publication No. 2000-347445

SUMMARY

As described above, demanded has been a method in which an electrostatic charge image developing toner (hereinafter, simply referred to also as toner) usable for a downsized color image forming apparatus capable of printing rapidly with no concern of production cost is prepared.

It is an object of the present invention to provide the toner capable of generating rapid charge rising capability any time soon with no influence on the conditions of print preparation and apparatus installation, which possesses durability against crushing even though the toner used for color image formation as an electrostatic charge image developing toner undergoes a strong impact constantly. Disclosed is an electrostatic charge image developing toner possessing at least a resin and a colorant, wherein the electrostatic charge image developing toner contains 12-984 ppm of a polyvalent organic acid or a salt thereof.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE INVENTION

Figure 1:
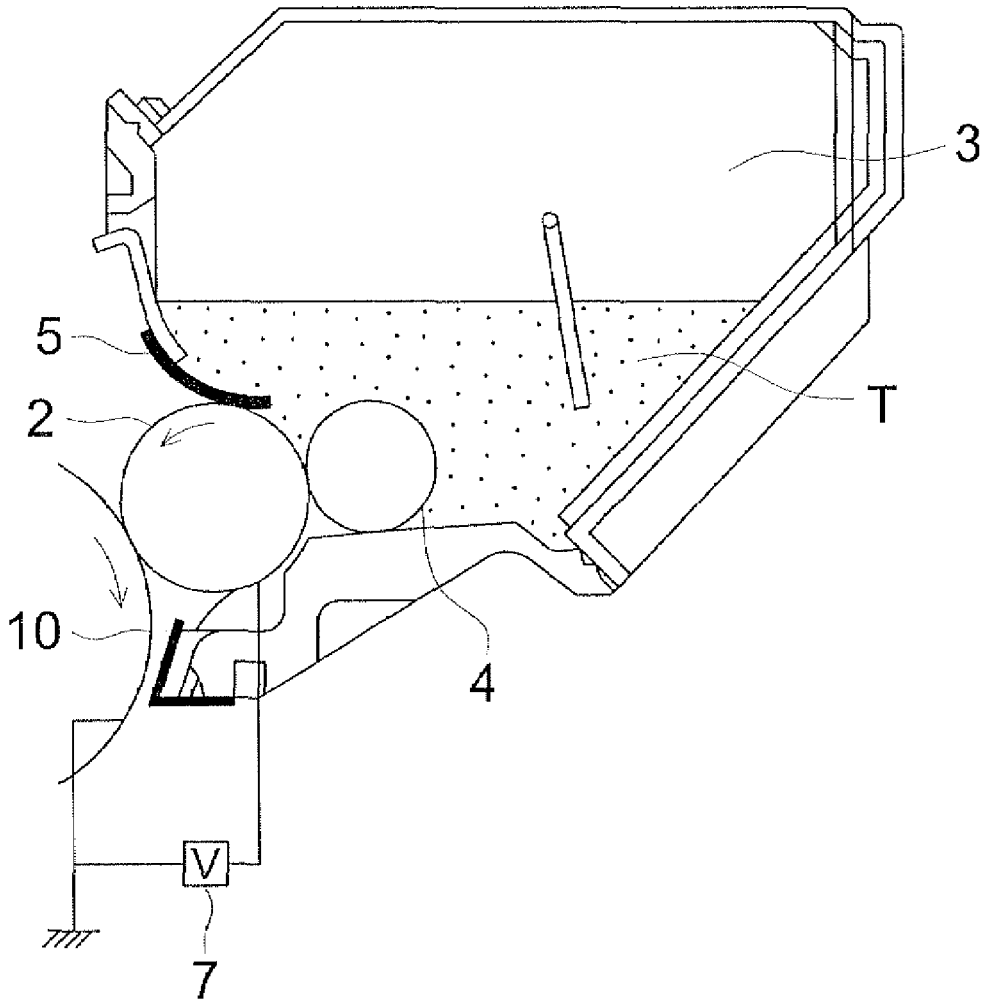
FIG. 1 is a schematic cross-sectional view of an example of developing device for non-magnetic single component toner development.

The present invention relates to the toner containing a specified amount of a polyvalent organic acid or a salt thereof.

It is found that heave-duty toner durable against an impact given within a developing device can be obtained by containing the foregoing polyvalent organic acid or the salt thereof in the present invention. It is assumed that the repulsive charge is stably formed on the coagulated particle surface via action of a polyvalent organic acid or a salt thereof contained in the toner, thought the reason why such the highly durable toner is obtained is not clear. That is to say, it is assumed that a strong binding force (coagulation force) between coagulated particles is to be generated since a material present in an aqueous medium is hardly engulfed on the coagulated particle surface, whereby no impurities are possibly contained via formation of the repulsive charge on the coagulated particle surface. In the prior art, though an ionic surfactant such as dodecyl sodium sulfate or so forth is present in an aqueous medium to form toner particles, the surfactant is inactivated by adding a coagulant, and it becomes difficult to form the repulsive charge on the toner surface. As a result, it is assumed that the material in the aqueous medium is easily engulfed on the coagulated particle surface, and the slight amount of material acted as impurities to prevent the binding force between coagulated particles. A technique in which the repulsive charge is formed on the coagulated particle surface by adding the polyvalent organic acid or the salt thereof in a process of coagulating coagulated particles in this manner to strengthen the binding force between coagulated particles would not be easily found via suggestion or motivation of the prior art.

Next, the present invention will be described in detail.

It is a feature that the toner of the present invention contains 12-984 ppm of a polyvalent organic acid or a salt thereof. The amount of the polyvalent organic acid or a salt thereof is preferably 12 to 200 ppm.

The molecular weight of the compound is 47-1500, and preferably 120-1000.

The polyvalent organic acid of the present invention is a compound from which at least two protons per one molecule can be provided, or a compound having a pKa (acid electrolytic dissociation exponent) value of at least 2.

The polycarboxylic acid is a compound having at least two carboxyl groups in a molecule, preferably a compound having at most 12 carbon atoms in a molecule, and more preferably not less than 2 carbon atoms.

The oxo acid is a compound having a carboxyl group and a hydroxyl group in one molecule, and falls into the category of polyvalent organic acid in the present invention.

The amino acid is a compound having a carboxyl group and an amino group in one molecule, and also includes an imino group.

The polyvalent organic acid described here means an organic acid (acidic organic compound) having a pKa (acid electrolytic dissociation exponent) value of at least 2.

A dissociative functional group is contained in the structure of these compounds. Examples of compounds having the dissociative functional group include a polycarboxylic acid, an oxo acid, an amino acid, a sulfonic acid compound, an amino acid compound, a phosphoric acid compound, a sulfuric acid compound and so forth. These compounds are dissociated in an aqueous medium, which possess a pKa (acid electrolytic dissociation exponent) value of at least 2. In the present invention, among the above-described polyvalent organic acids, a polycarboxylic acid, an oxo acid and an amino acid are particularly preferable.

A metal salt formed by combining a dissociative functional group in the foregoing polyvalent organic compound with a metal ion is usable in the present invention. As the metal salt, the monovalent metal such as sodium, potassium or lithium is preferable.

Next, specific examples of the polyvalent organic acid usable in the present invention are exemplified. Incidentally, organic compounds shown in (1-1)-(1-25) and (7-1)-(7-7) correspond to the polycarboxylic acid, organic compounds shown in (2-1)-(6-2) correspond to the oxo acid, and organic compounds shown in (8-1)-(10-8) correspond to the amino acid.

(1-1) $HOOC—COOH$ (1-2) $HOOC—CH_2—COOH$ (1-3) $HOOC—(CH_2)_2—COOH$ (1-4) $HOOC—(CH_2)_3—COOH$ (1-5) $HOOC—(CH_2)_4—COOH$ (1-6) $HOOC—(CH_2)_5—COOH$ (1-7) $HOOC—(CH_2)_6—COOH$ (1-8) $HOOC—(CH_2)_7—COOH$ (1-9) $HOOC—(CH_2)_8—COOH$ (1-10) $HOOC—(CH_2)_9—COOH$ (1-11) $HOOC—(CH_2)_{10}—COOH$ (1-12) $HOOC—CH(CH_3)—COOH$ (1-13) $HOOC—C(CH_3)_2—COOH$ (1-14) $HOOC—CH(CH_3)CH_2—COOH$ (1-15) $HOOC—CH_2CH(CH_3)CH_2—COOH$ (1-16) $HOOC—CH_2C(CH_3)_2CH_2—COOH$ (1-17)

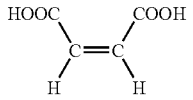

(1-18)

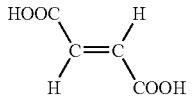

(1-19)

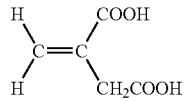

(1-20)

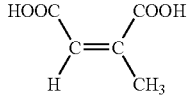

(1-21)

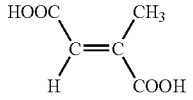

-continued (1-22)

$HOOC—CH_2CH{=}CH—COOH$ (1-23)

$HOOC—CH{=}CHCH{=}CH—COOH$ (1-24)

$HOOC—CH_2CO—COOH$ (1-25)

$HOOC—CO—COOH$ (2-1)

$HO—CH(CH_3)—COOH$ (2-2)

$HO—CH_2CH_2—COOH$ (2-3)

$HO—CH_2—COOH$ (2-4)

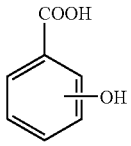

(2-5)

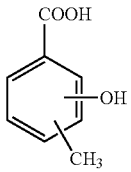

(2-6)

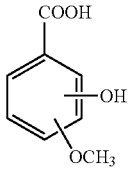

(2-7)

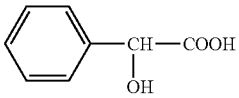

(2-8)

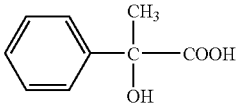

(2-9)

$(C_6H_5)_2—C(OH)—COOH$ (2-10)

$CH_3CH(CH_3)CH_2—CH(OH)—COOH$ (3-1)

$HOOC—CH_2CH(OH)—COOH$ (3-2)

$HOOC—CH(OH)—COOH$ (4-1)

$HO—CH_2CH(OH)—COOH$

-continued (4-2)

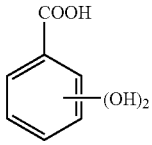

(4-3)

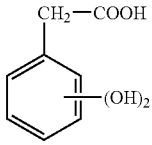

(4-4)

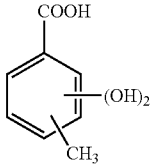

(4-5)

$HO—CH_2CH_2—C(CH_3)(OH)—CH_2—COOH$ (4-6)

$HO—CH_2—C(CH_3)_2—CH(OH)—COOH$ (5-1)

$HOOC—CH(OH)—CH(OH)—COOH$ (6-1)

$HOOC—CH_2—C(COOH)(OH)—CH_2—COOH$ (6-2)

$HOOC—CH_2—CH(COOH)—CH(OH)—COOH$ (7-1)

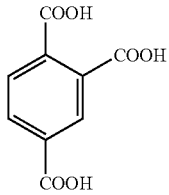

(7-2)

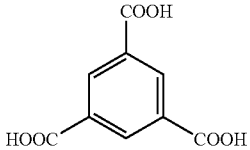

(7-3)

$HOOC—CH_2—C(COOH){=}CHCOOH$ (7-4)

$HOOC—CH_2—CH(COOH)—CH_2—COOH$

-continued (7-5)

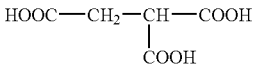

(7-6)

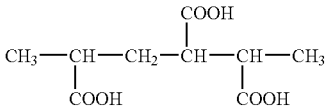

(7-7)

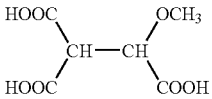

(8-1)

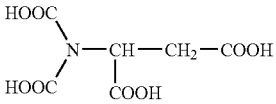

(8-2)

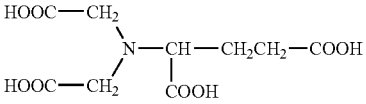

(8-3)

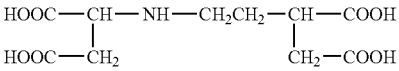

(8-4)

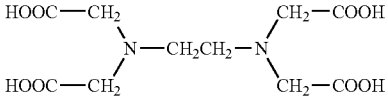

(8-5)

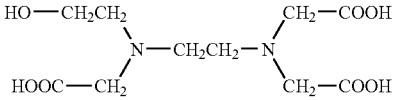

(8-6)

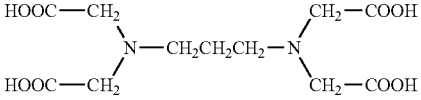

(8-7)

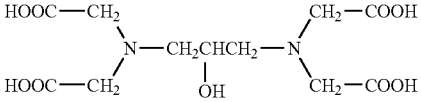

(9-1)

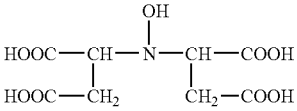

(9-2)

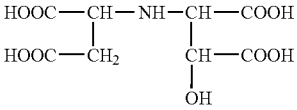

(10-1)

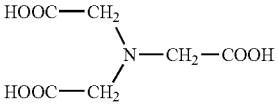

(10-2)

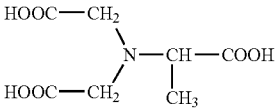

-continued (10-3)

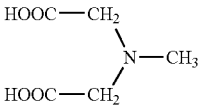

(10-4)

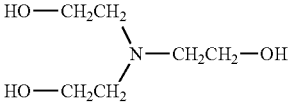

(10-5)

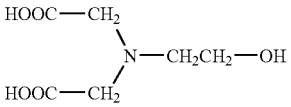

(10-6)

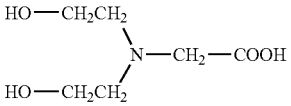

(10-7)

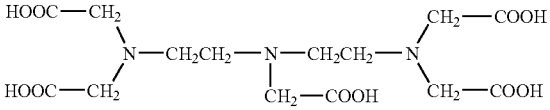

(10-8)

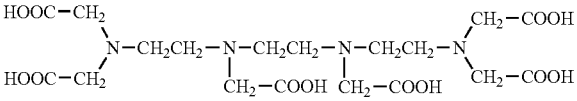

In addition, a compound, in which the H atoms in a carboxyl group and a hydroxyl group contained in a polyvalent organic acid compound are replaced by the foregoing metal atoms, corresponds to a polyvalent organic acid compound salt of the present invention.

Among the above-described exemplified compounds, examples of compounds preferably usable in the present invention include (2-1), (2-4), (3-1), (5-1), (6-1), (6-2), (9-2), (9-3), (10-1) and (10-8).

The amount of a polyvalent organic acid or a salt thereof can be measured by the following measuring method.

1. Extraction procedures <1-1>-<1-2> concerning measured toner are conducted.

<1-1> A 10 ml methanol solution containing 1 N of a hydrochloric acid is added into 500 mg of toner, and the system is stirred employing an ultrasonic homogenizer.

<1-2> The resulting is filtrated by a Chromatodisc having a sieve of 0.2 μm, and the filtrated liquid is diluted with ultrapure water by 10 times.

2. The resulting aqueous solution in the above-described <1-2> is analyzed by ion chromatography under the following condition of <2-1>. Regarding the structure determination of the resulting peak, the structure is determined by a commonly known method after the sample-splitting. The structure is specifically determined by mass spectroscopy and nuclear magnetic resonance analysis (NMR) in accordance with the retention time of a standard sample. After the determination of the structure, a calibration curve is prepared employing a standard sample having the same structure. Further, in comparison with the peak area, an amount of polyvalent organic acid contained in toner is determined via conversion by using the concentration of liquid extracted from the resulting toner. Incidentally, in the case of containing a plurality of polyvalent organic acids, the sum is designated as the amount of polyvalent organic acid contained in toner.

<2-1> Ion chromatography apparatus condition

Detection: ODS-80TM (manufactured by Tosoh Corp.) 4.6×250 mm and ODS-80TM (manufactured by Tosoh Corp.) 4.6×150 mm Flow rate: 0.5 ml/min Carrier: 5 mM ammonium dihydrogenphosphate (pH=2.4)

Column temperature: 25° C.

Analysis amount: 20 μl

Analysis time: 45 min.

Incidentally, 1.15 g of ammonium dihydrogenphosphate (special grade) was dissolved in 1980 g of ion-exchange water, the resulting was adjusted to pH 2.40 with 85% by weight of orthophosphate, and ion-exchange water was further added to make 2000 g while stirring and to prepare the carrier.

The toner of the present invention preferably contains 4-90 ppm of a sodium element.

The toner of the present invention preferably contains 600-1650 ppm of a divalent or trivalent metal element. Examples of the divalent metal element include Ca, Mg, Mn, Cu and so forth. Examples of the trivalent metal element include Al, Fe and so forth.

Next, toner properties of the present invention will be explained.

<Volume-Based Median Particle Diameter ($D_{50}$)>

It is preferred that volume-based median particle diameter ($D_{50}$) of the present invention is 3-9 μm.

Volume-based median particle diameter ($D_{50}$) and the variation coefficient in a volume-based particle size distribution for toner can be measured and calculated by using Coulter Multisizer 3 (produced by Beckman Coulter Inc.), connected to a computer system (produced by Beckman Coulter Inc.) for data processing.

After 20 ml of the surfactant solution (surfactant solution in which a neutral detergent containing a surfactant is diluted with pure water by 10 times) is mixed with 0.02 g of toner for the measurement, the mixture was subjected to an ultrasonic dispersion for one minute to obtain a toner dispersion. This toner dispersion is then poured, using a pipette, in a beaker containing ISOTON II (produced by Beckman Coulter Inc.) placed in a sample stand, until the measured content reaches 8% by weight, and a counter is set to 2500 counts to be measured. In addition, an aperture diameter of 50 μm is used.

(Variation Coefficient in Volume-Based Particle Size Distribution)

Variation coefficient in a volume-based particle size distribution for toner in the present invention is preferably 8-21%, and more preferably 10-19%.

The variation coefficient in the volume-based particle size distribution is calculated according to the following expression.

$$\text{Volume variation coefficient}(\%)=(S_2/D_n)\times 100$$

In the above expression, $S_2$ is a standard deviation of the volume-based particle size distribution and $D_n$ is volume-based median particle diameter ($D_{50}$).

(Average Circularity)

The average circularity of toner in the present invention is preferably 0.951-0.990.

The toner circularity is defined in the following expression.

Circularity=(Peripheral length of circle having the same area as the projected image of a toner particle)/(Peripheral length of the projected image of a toner particle)

The average circularity is a calculated value obtained by dividing the summation value of circularity of each particle by the total number of particles.

Circularity of toner is a measured value employing FPIA-2100 manufactured by Sysmex Corporation. The measurement is specifically conducted under the measuring conditions such as an HPF (high-power field imaging) mode and an appropriate concentration of a HPF detection number of 3000-10000 employing FPIA-2100, after toner mixed with a surfactant-containing aqueous solution is subjected to ultrasonic dispersion treatment for 1 minute to disperse the toner.

(Crushability Index)

In the present invention, strength with respect to crushability of toner particles is evaluated in terms of "Crushability index".

The crushability index is an index representing the crushability of the toner particles, and specifically, it is determined by the following measuring procedure.

(Measuring Procedure)

Thirty grams of a toner sample, 100 g of glass beads GB503M (an average particle diameter of 2 mm), produced by Toshiba-Barotini Co., Ltd., are charged into a 2 liter polyethylene pot, and stirred for 60 seconds by a tabular mixer. Then the glass beads are separated by a sieve of 300 meshes. Thereafter, the volume ratio in percent of particles having a volume-based median particle diameter ($D_{50}$) of 2-4 μm, based on the whole particles collected by the sieve is measured, and the index is determined by the following equation.

Equation $$\text{Crushability index}=(N-N_0)/60$$

In the equation, N is the volume ratio in percent of particles having a volume-based median particle diameter ($D_{50}$) of 2-4 μm, after stirring, and $N_0$ is the volume ratio in percent of particles having a volume-based median particle diameter ($D_{50}$) of 2-4 μm, before stirring. The volume ratio in percent of particles are measured employing Coulter Multisizer 3 (produced by Beckman Coulter Inc.), and calculated. In addition, an aperture diameter of 30 mm is used.

(Method of Manufacturing Toner)

A method of manufacturing toner in the present invention is not particularly limited, but a typical method is a method of manufacturing toner via a process of coagulating resin particles after forming the resin particles via emulsion polymerization.

An example of the method of manufacturing the toner via a process of coagulating resin particles will be described in detail.

This manufacturing method of toner may include the following processes:

(1) a polymerization process of preparing a resin particle dispersion via polymerization of a polymerizable monomer; (2) a coagulation process of forming a toner particle intermediate body obtained as a toner base material by coagulating toner particle constituent material such as resin particles or colorant particles in an aqueous medium (hereinafter, referred to as a process of coagulating resin particles); (3) a shape control process of controlling a shape, after conducting process (2) followed by a process of heating while stirring and completing fusion of a material constituting a toner particle intermediate body; (4) a solid-liquid separation and washing process of separating the resulting toner particle intermediate body from an aqueous medium, and washing the toner particle intermediate body surface; (5) a drying process of drying the toner particle intermediate body which was subjected to solid-liquid separation and washing treatment; and (6) an external additive treatment process of preparing toner usable for image formation via addition of external additives into the toner particle intermediate body which was subjected to dry treatment.

Next, each of the processes will be concretely described.

[Polymerization Process]

In a preferred example of the polymerization process, liquid droplets are formed employing mechanical energy by adding the radically polymerizable monomer solution in an aqueous medium containing a surfactant to develop polymerization reaction in the liquid droplets via the subsequent addition of a water-soluble radical polymerization initiator. Incidentally, resin particles may be added into the foregoing aqueous medium as the core particle.

It is preferred that an amount of a chain transfer agent is changed to control a molecular weight distribution in several steps in the polymerization process. Resin particles are obtained via this polymerization process.

The resin particle may contain a releasing agent (wax), or contain a colorant. Colored resin particles are obtained via polymerization treatment of a monomer composition containing a colorant.

In the case of employing uncolored resin particles, a toner particle intermediate (toner base material) can also be prepared by adding a colorant particle dispersion into a resin particle dispersion in a coagulation process to coagulate resin particles with colorant particles.

[Process of Coagulating Resin Particles]

This process is the case for "a process for growing particles by coagulating resin particles in an aqueous medium" in the present invention. In the present invention, this process is a process in which at least one of a polyvalent organic acid and a salt thereof is added into an aqueous medium during the proceeding coagulation of resin particles. In this process, the toner particle intermediate (which means the particle prior to providing a function as a toner via the final treatment such as external additive treatment or such, and is also called a toner base material or a colored particle) is formed by coagulating resin particles produced in a polymerization process with a toner particle constituent material such as a colorant particle or such. In addition, in this process, a fusing step in which coagulated particles are strongly bound with coagulated particles is thermally conducted.

It is preferred that fusion of resin particles with a colorant is proceeded while coagulating. The fusion by a heater may be conducted at once after terminating the coagulation.

Specifically, an interparticle electrostatic repulsion of resin particles or colorant particles is reduced by adding a divalent or trivalent salt into an aqueous medium, so that coagulation becomes possible, whereby these particles are coagulated with each other and grown to form a toner particle intermediate. Coagulated particles subjected to heat application are bound with each other and fused. The toner particle intermediate is formed and grown in this manner.

An addition amount of a polyvalent organic acid and a salt thereof is preferably 0.8-2.8 parts by weight, based on 100 parts by weight of an aqueous medium. The above-described addition amount confirms that effects of the present invention are possible to be more definitely produced.

A process of coagulating resin particles will further be described. In a process of coagulating particles, particles are fused at a temperature of not less than a glass transition temperature of the resin particles while coagulating the resin particles or colorant particles produced in a polymerization process, as described before.

Regarding coagulation of particles, there is a method in which coagulated particles are fused by raising the temperature while coagulating particles after mixing a resin particle dispersion and colorant particle dispersion at not more than the glass transition temperature of resin particles to conduct the coagulation of particles.

In view of the above-described, in a process of coagulating resin particles, coagulation and fusion proceed in parallel, and preferably usable is a method called a so-called "salting-out/fusing method" in which heating is continuously applied to control the particle shape, if desired, while growing particles up to a desired particle diameter.

In addition, "aqueous medium" in the present invention means the main component (at least 50% by weight) is composed of water. As a component other than water, for example, provided is a water-soluble organic solvent such as methanol, ethanol, isopropanol, butanol or acetone.

Coagulation of particles is also performed by adding a divalent salt and so forth. Examples of metal salts for performing coagulation include a monovalent alkali metal salt of sodium, potassium, lithium or the like; a divalent metal salt of calcium, magnesium, manganese, copper or the like; and a trivalent metal salt of aluminum, iron or the like. Specific examples of these include sodium chloride, potassium chloride, lithium chloride, calcium chloride, magnesium chloride, zinc chloride, copper sulfate, magnesium sulfate and manganese sulfate. These salts may be used singly or in combination with at least 2 kinds.

Of these metal salts, divalent metal salts are preferable, since coagulation can be performed with the reduced addition amount.

It is preferable that the addition amount of these metal salts is added in such a way that the metal salt concentration is at least the critical coagulation concentration in an aqueous medium. Specifically, at least 1.2 times of the critical coagulation concentration are preferable, and at least 1.5 times of the critical coagulation concentration are more preferable. The critical coagulation concentration described here is a measure with respect to stability of an aqueous dispersion. The critical coagulation concentration can be precisely determined according to techniques described in, for example, S. Okamura et al., Kobunshi Kagaku (Polymer Chemistry) 17, 601 (1960), edited by Kobunshi-gakkai. While adding an intended salt into an objective dispersion for coagulation with varying the concentration thereof, the ζ-potential of the dispersion is measured and the salt concentration at which the potential changes is possible to be determined as the critical coagulation concentration.

It is also possible to coagulate a toner particle constituent material such as wax, a fixing aid or a charge control agent together with resin particles or colorant particles in a process of coagulating resin particles.

[Shape Control Process]

In a method of manufacturing toner of the present invention, heating is continuously applied while stirring to control the shape of a toner particle intermediate (toner base material) further after adding a polyvalent organic acid or a salt thereof in a process of coagulating the foregoing resin particles. Thus, the shape of a toner particle intermediate (toner base material)

is possible to be controlled to be roughly a sphere by lengthening a duration of heating while stirring.

[Solid-Liquid Separation and Washing Process]

In the solid-liquid separation and washing process, there are conducted a solid-liquid separation treatment of separating the toner particle intermediate body (toner base material) from a toner particle intermediate body (toner base material) dispersion, cooled to the prescribed temperature in the foregoing process and a washing treatment of removing an undesired material such as a surfactant or a salting-out agent from a separated toner cake (wetted aggregate of a toner particle intermediate body (toner base material) aggregated in a cake form).

The washing treatment is conducted until electrical conductivity of the filtrated liquid reaches 10 μS/cm.

Solid-liquid separation and washing methods are not limited to be used, but provided are a centrifuge separation method, a vacuum-filtration method employing a Buchner funnel or the like, and a filtration method employing a filter press and the like.

[Drying Process]

The drying process is a process of conducting drying treatment of a toner particle intermediate body which was subjected to washing treatment. In the drying process, drying treatment is usually conducted in the form of a toner cake. Provided as dryers employed in this process are a spray dryer, a vacuum-freeze dryer and a vacuum dryer, but preferably a stationary shelf dryer, a mobile shelf dryer, a fluidized-bed dryer, a tumble-drier, and a stirring type dryer. The water content of the dried toner intermediate body is preferably at most 5% by weight, and more preferably at most 2% by weight. In the case of the dried toner intermediate body (toner base material)-toner intermediate body coagulating together by weak inter-particle forces, the coagulated toner intermediate body may be pulverized. Examples of the pulverizing treatment apparatus include a jet mill, a Henschel mixer, a coffee mill, and a food processor.

[External Additive Treatment Process]

This process is a process of adding external additives into the dried toner particle intermediate body (toner base material), and preparing toner usable for image formation.

As the mixer of external additives, there are usable mechanical mixers such as a Henschel mixer and a coffee mill.

Next, the material used in the present invention will be described.

(Binder Resin)

The binder resin constituting resin particles is prepared via polymerization of a polymerizable monomer. As a polymerizable monomer usable for polymerization, provided can be a polymerizable monomer having a carboxyl group or a polymerizable monomer usable in combination with the polymerizable monomer having a carboxyl group.

Specific examples of the polymerizable monomer having a carboxyl group include methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl aminoethyl methacrylate and dimethyl aminoethyl methacrylate; ester acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; and acrylic acid or methacrylic acid derivatives such as acrylonitrile, methacrylonitrile, acrylamide and the like.

Examples of the polymerizable monomer usable in combination with the polymerizable monomer having a carboxyl group also include styrene or styrene derivatives such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene; olefins such as ethylene, propylene, isobutylene and the like; vinyl esters such as vinyl propionate, vinyl acetate, vinyl benzoate, and the like; vinyl ethers such as vinyl methyl ether, vinyl ethyl ether and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone and the like; and vinyl compounds such as vinylnaphthalene, vinylpyridine and the like.

Further, it is more preferable that those having ionic dissociation groups as polymerizable monomers constituting resins are used in combination. Examples thereof are those each having a substituent such as carboxyl group, sulfonic acid group and phosphoric acid group as a constituting group of a monomer, and there are specifically given acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamido-2-methylpropanesulfonic acid and acidphosphoxyethyl methacrylate.

It is further possible to produce resins having a cross-linked structure by using polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

Further, when using an emulsion association method, a water-soluble radical polymerization initiator is usable. Provided as the water-soluble polymerization initiator are persulfate such as potassium persulfate and ammonium persulfate, azobisamino dipropane acetate, azobiscyano valeric acid and its salt and hydrogen peroxide.

It is preferred that the resin constituting toner of the present invention has a number average molecular weight (Mn) of 1,000-100,000, and a weight average molecular weight (Mw) of 2,000-1,000,000. The molecular weight of a resin constituting toner is possible to be determined by the gel permeation chromatography method, for example.

The molecular weight measured by the gel permeation chromatography method (hereinafter, referred to also as GPC) will be described here.

The measurement is conducted by the following procedures. First, 1 ml of a tetrahydrofuran solvent is added into 1 mg of a measured resin sample and stirred using a magnetic stirrer at room temperature until sufficiently dissolved. Subsequently, after filtering through a membrane filter having a pore size of 0.45-0.50 μm, a sample for measurement of the GPC is prepared. Measurement is conducted under the condition that after the GPC measurement column being stabilized at 40° C., tetrahydrofuran flows at a rate of 1 ml per min. and 100 μl of a sample having a concentration of 1 mg/ml is injected to conduct the measurement. Combined use of commercially available polystyrene gel columns is preferred. Examples thereof include combinations of Shodex GPC KF-801, 802, 803, 804, 806 and 807 (produced by Showa Denko Co., Ltd.); the combination of TSK gel G1000H, G2000H, G3000H, G4000H, G5000H, G6000H, G7000H and TSK guard column (produced by TOSOH CORP.). A refractive index detector (IR detector) or a UV detector is preferred as the detector used.

The number average molecular weight and the weight average molecular weight of the tetrahydrofuran solvent component in resin particles are represented by a molecular weight in terms of styrene resin conversion. The molecular weight in terms of styrene resin conversion is determined by a styrene calibration curve. About 10 points of monodisperse polystyrene standard polystyrene may preferably be measured to prepare a styrene calibration curve.

(Colorant)

Commonly known inorganic or organic colorants may be employed as colorants of the present invention. Specific colorants are shown below.

Black colorants are carbon black such as furnace black, channel black, acetylene black, thermal black, and lamp black, and magnetic powder such as magnetite and ferrite.

Examples of colorants for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48; 1, C.I. pigment red 53; 1, C.I. pigment red 57; 1, C.I. pigment red 122, C.I. pigment red 123, C.I. pigment red 139, C.I. pigment red 144, C.I. pigment red 149, C.I. pigment red 166. C.I. pigment red 177, C.I. pigment red 178, and C.I. pigment red 222.

Examples of colorants for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 74, C.I. pigment yellow 93, C.I. pigment yellow 94, and C.I. pigment yellow 138.

Examples of colorants for green or cyan include C.I. pigment blue 15, C.I. pigment blue 15; 2, C.I. pigment blue 15; 3, C.I. pigment blue 15; 4, C.I. pigment blue 16, C.I. pigment blue 60, pigment blue 62, pigment blue 66, and C.I. pigment green 7.

Incidentally, these colorants can be used singly or two kinds of colorants or more can be selected in combination if desired. The addition amount of colorant is 1-30% by weight, based on the total amount of toner, and is preferably arranged to be set in the range of 2-20% by weight.

(Chain Transfer Agent)

Conventional chain transfer agents are usable to adjust the molecular weight of resin. Chain transfer agents are not specifically limited and examples thereof include mercaptans such as n-octylmercaptan, n-dodecylmercaptan and tert-dodecylmercaptan; mercaptopropionic acid esters such as n-octyl-3-mercaptopropionic acid ester and the like; terpinolene; and α-methylstyrene dimmer.

(Wax)

Commonly known compounds can be employed as wax usable in the present invention.

Examples thereof include polyolefin wax such as polyethylene wax and polypropylene wax; long chain hydrocarbon wax such as paraffin wax and sasol wax; dialkylketone type wax such as distearylketone; ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristarate, and distearyl meleate; and amide type wax such as ethylenediamine dibehenylamide and trimellitic acid tristearylamide.

The wax content of toner is preferably 1-20% by weight, and more preferably 3-15% by weight.

(Charge Control Agent)

A charge control agent may be added into toner of the present invention, if desired. Commonly known compounds can be used as the charge control agent.

(External Additive)

Commonly known particles can be used as inorganic particles employed for external additives. Specifically, preferable examples of those particles include silica particles, titania particles, alumina particles, and their composite oxides. It is also preferred that these inorganic particles are hydrophobic.

Spherical particles having a number average primary particle diameter of 10-2000 nm can be provided as organic particles used for external additives. Examples of constituent material for organic particles include polystyrene, polymethylmethacrylate, styrene-methylmethacrylate copolymer, and the like.

The toner of the present invention can be employed as a single-component developer or a double-component developer.

When the toner is used as a single-component developer, the toner is usually employed in a form of a non-magnetic single component toner developer or a magnetic single component toner developer in which the toner contains a magnetic particle having a diameter of approximately 0.1-0.5 μm, but both developers may be used.

When the toner is employed as a double-component developer by mixing with a carrier composed of magnetic particles, known metals such as iron, ferrite and magnetite and alloys of the metals with another metal such as aluminum and lead are employable. Of these, the ferrite particle is particularly preferred. The particle diameter of the above carrier is preferably 20-100 μm, and more preferably 25-80 μm.

The toner of the present invention is preferably used as a non-magnetic single component developer in view of downsizing of a developing apparatus and low cost.

Next, an image forming apparatus of forming a toner image employing the toner of the present invention will be described.

An example of developing method in the case of conducting non-magnetic single component toner development employing toner of the present invention will be described, but the present invention is not limited thereto.

FIG. 1 is a schematic cross-sectional view of an example of developing device for non-magnetic single component toner development.

Numeral 10 indicates a latent image carrier (photoreceptor drum), and the latent image is formed by a electrophotographic process means or a electrostatic recording means. Numeral 2 indicates a developing sleeve, which is a non-magnetic sleeve made of aluminum, stainless or such.

A raw aluminum or stainless steel base pipe can be directly used as the developing sleeve, but it is preferable that its surface is made coarse by blasting glass beads or such to the surface, treated to have a mirror-surface, or coated with a resin.

Toner T is stored in hopper 3 and fed onto the surface of the toner carrier by supplying roller 4. The supplying roller made of a foamed material such as polyurethane foam rotates forward or backward at a speed relative to the speed of the toner carrier to supply the toner onto the surface of the toner carrier and rub off the toner after development (undeveloped toner) from the surface of the toner carrier. The toner supplied onto the toner carrier is controlled by even thin toner layer formation and toner controlling blade 5 being a kind of toner-layer-thickness controlling members.

It is effective that a contact pressure between the toner controlling blade and the toner carrier is 3-250 N/m as a linear pressure in the sleeve base line direction, and preferably 5-12 N/m. In the case of a contact pressure of less than 3 N/m, it is difficult to coat the toner evenly, and a problem caused by fog and scattered toner tends to be produced, since a charging amount distribution of toner becomes broader. In the case of a contact pressure exceeding 250 N/m, it is not preferable that toner coagulation is generated, since the toner is deteriorated by large pressure applied to the toner. It is not also preferable that a large torque is applied to operate the toner carrier. That is, it becomes possible to produce an even, thinner layer of the toner of the present invention on a toner carrier by adjusting the contact pressure to 3-250 N/m, and also to raise the charging amount of toner instantaneously.

The toner-layer-thickness controlling member is preferably an elastic blade or roller made of a frictional charge system material suitable to give a predetermined polarity to the toner.

Preferable materials are silicone rubber, urethane rubber, styrene-butadiene rubber and so forth. Further, provided may be an organic resin layer made of polyamide, polyimide, nylon, melamine, melamine cross-linked nylon, a phenol resin, a fluorine based resin, a silicone resin, a polyester resin, an urethane resin or a styrene based resin. Further, a dielectric property or a charge providing property is given by dispersing electrically conductive resin, or charge control agent or filler such as metal oxide, carbon black, inorganic whisker or inorganic fiber into the blade rubber or blade resin, so that it is preferable that toner can be appropriately charged.

Incidentally, in a system to coat a thin layer of toner onto a developing sleeve with a blade, it is preferred that the toner layer thickness on the developing sleeve is arranged to be thinner than the facing gap length between the developing sleeve and the photoreceptor drum, and an alternating electric field is applied to this gap to obtain sufficient image density. That is, the toner transfer from the developing sleeve surface onto the photoreceptor surface is facilitated, whereby a high quality image can further be obtained by applying an alternating electric field or a development bias in which a direct current electric field is superposed on an alternating electric field at the portion between developing sleeve 2 and photoreceptor drum 10 via bias source 7 as shown in FIG. 1.

The toner of the present invention is preferably usable for an image forming method including a process of fixing by directing a transfer material with the formed toner through a passage between a heat roller and a pressure roller constituting a fixing device.

Figure 2:
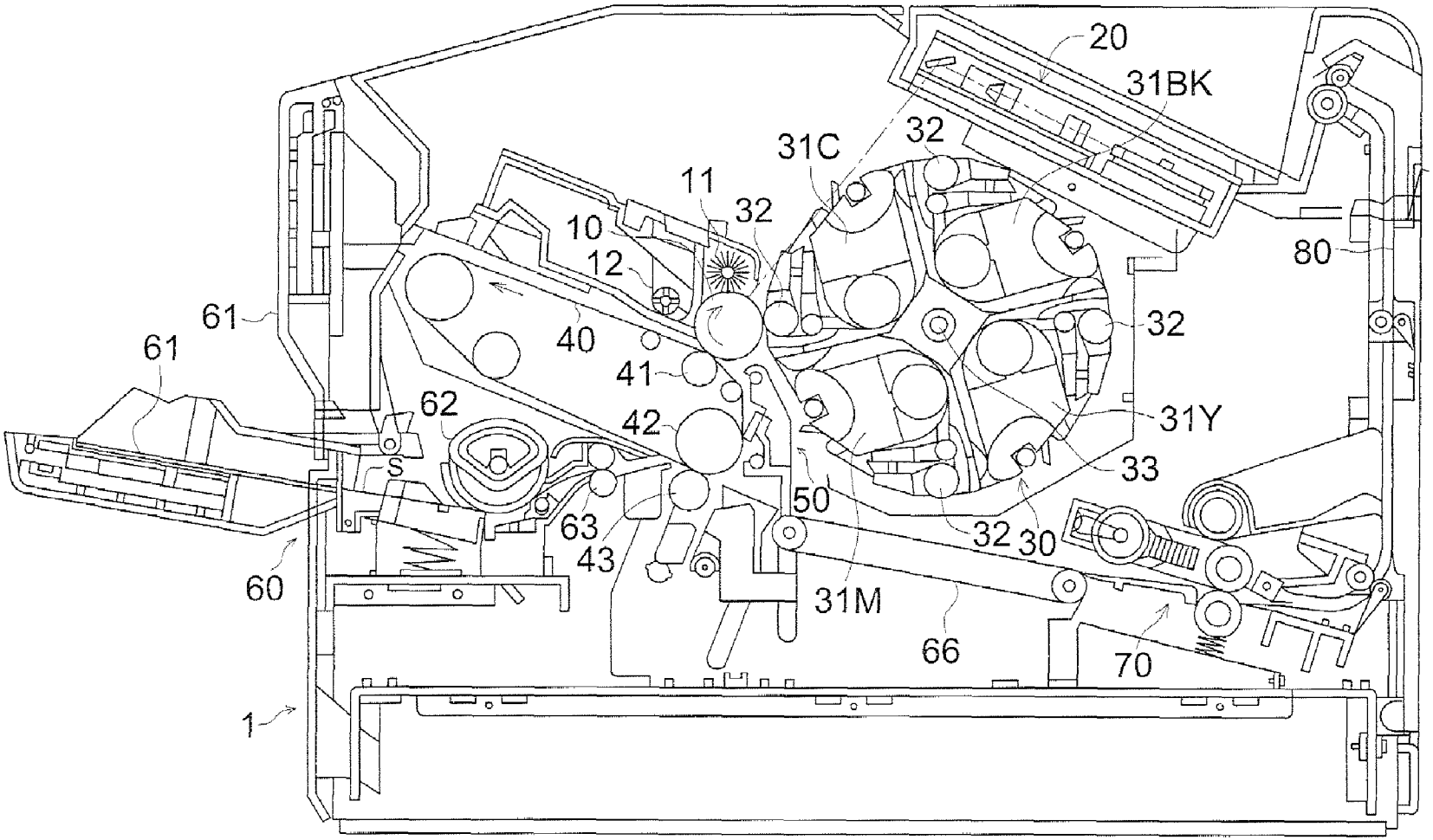
FIG. 2 is a schematic cross-sectional view of an example of full color image forming apparatus for forming an image by using toner of the present invention.

FIG. 2 is a schematic cross-sectional view of an example of full color image forming apparatus for forming an image by using toner of the present invention.

In the full color image forming apparatus shown in FIG. 2, charging brush 11 for uniformly electrically charging the surface of photoreceptor drum 10 at a predetermined potential, and cleaner 12 for scraping the toner remaining on photoreceptor drum 10 are arranged around photoreceptor 10.

Moreover, laser scanning optical system 20 for exposing photoreceptor 10 electrically charged by charging brush 11 to a laser beam is provided. Laser scanning optical system 20 is known one including a laser diode, a polygon mirror and an fθ optical element, and cyan, magenta, yellow and black data to be printed are transferred from a host computer to the controlling means thereof. Laser scanning optical system 20 successively outputs laser beams according to the data of each of the above colors obtained via scanning exposure onto photoreceptor drum 10 for successively forming electrostatic latent images on photoreceptor drum 10.

Developing apparatus 30 for supplying each of the color toners to photoreceptor drum 10 to perform full color development is constituted by four developing devices 31C, 31M, 31Y and 31Bk each containing a cyan, magenta, yellow and black non-magnetic single-component toners, respectively, which are arranged around supporting axis 33. The developing devices can be rotated around supporting axis 33 so that each of developing devices 31C, 31M, 31Y and 31Bk is successively introduced at a position facing to photoreceptor drum 10.

In each of developing devices 31C, 31M, 31Y and 31Bk of full color developing apparatus 30, toner controlling member (toner controlling blade) 5 is brought into contact by pressure with developing roller (developing sleeve) 2 for conveying the toner by rotation. The amount of the toner conveyed by developing sleeve 2 or 32 is regulated by toner controlling member 5 and the conveyed toner is electrically charged at the same time. In this full color developing apparatus 30, two toner controlling members may be provided to suitably perform the control and to electrically charge the toner conveyed by developing sleeve 2 or 32.

Full color developing apparatus 30 is rotated around supporting axis 33 every time the electrostatic latent image of each color is formed so that developing devices 31C, 31M, 31Y and 31Bk each containing the corresponding color toner are successively introduced to the position where the developing device is faced to photoreceptor drum 10. And then each of the color toners is successively supplied onto the electrostatic latent image successively formed on photoreceptor drum 10 by contacting developing sleeve 32 contained in each of developing devices 31C, 31M, 31Y and 31Bk to perform the development.

Endless intermediate transfer belt 40 is also provided at the lower course from full color developing apparatus 30 in the rotating direction of photoreceptor drum 10. This intermediate transfer belt 40 is driven for synchronously rotating with photoreceptor drum 10. Intermediate transfer belt 40 is brought into contact with photoreceptor drum 10 by pressing with rotatable primary transfer roller 41, and rotatable secondary transfer roller 43 is provided for facing to support roller 42 supporting intermediate transfer belt 40. Recording material S such as recording paper is pressed by secondary transfer roller 43 to be brought into contact by pressure with intermediate transfer roller 40.

Cleaner 50 for scraping off the toner remaining on intermediate transfer belt 40 is provided in the space between full color developing apparatus 30 and intermediate transfer belt 40 so that cleaner 50 is capable of contacting to or releasing from intermediate transfer belt 40.

Paper supplying means 60 for introducing transfer material S such as recording paper to intermediate transfer belt 40 is constituted by paper supplying tray 61 for storing transfer material S, paper supplying roller 62 for supplying one by one recording material S stored in paper supplying tray 61 and timing roller 63 for sending transfer material S between intermediate transfer belt 40 and secondary transfer roller 43 synchronously with the image formed on intermediate transfer belt 40. Transfer material S conveyed between intermediate transfer belt 40 and secondary transfer roller 43 is pressed against intermediate transfer belt 40 by secondary transfer roller 43 so that the toner image is transferred by press onto transfer material S.

Transfer material S on which the toner image is transferred by press is introduced to fixing device 70 by conveying means 66 constituted by an air suction belt. The toner image transferred onto transfer material S is fixed in fixing device 70, and then transfer material S is taken out on the upper face of image forming apparatus 1 through vertical conveying pass 80.

Procedures for forming a full color image employing this full color image forming apparatus are described below.

Photoreceptor drum 10 and intermediate transfer belt 40 are rotated at the same circumferential speed in each of their directions and photoreceptor drum 10 is electrically charged to a predetermined potential by charging brush 11.

An electrostatic latent image of a cyan image is formed by exposing charged photoreceptor drum 10 according to the cyan image data by laser scanning optical system 20. And then a cyan image is developed by supplying an electrically charged cyan toner onto photoreceptor drum 10 from developing device 31C containing the cyan toner through the toner controlling member. The cyan toner image formed on photoreceptor drum 10 is primarily transferred onto intermediate transfer belt 40 by contacting by press intermediate transfer belt 40 to photoreceptor drum 10 by primary transfer roller 41.

After transferring the cyan toner image onto intermediate transfer belt 40, full color developing apparatus 30 is rotated around supporting axis 33 for introducing developing device 31M containing magenta toner to the position for facing to photoreceptor drum 10. And then a magenta image is exposed to light with respect to photoreceptor drum 10 charged by laser scanning optical system 20 to form an electrostatic latent image in the same manner as in the cyan image formation. The electrostatic latent image is developed by developing device 31M containing the magenta toner, and the developed magenta toner image is primarily transferred onto intermediate transfer belt 40 from photoreceptor drum 10. Furthermore, exposure, development and primarily transfer of a yellow image as well as a black image are successively performed so that a full color toner image is formed by successively piling the cyan, magenta, yellow and black images on intermediate transfer belt 40.

After primarily transferring the last black image onto intermediate transfer belt 40, transfer material S is conveyed by timing roller 63 between secondary transfer roller 43 and intermediate transfer belt 40, and the full color toner image formed on intermediate transfer belt 40 is secondarily transferred onto transfer material S by pressing transfer material S against intermediate transfer belt 40 by secondary transfer roller 43.

After secondarily transferring the full color toner image onto transfer material S, transfer material S is introduced into fixing device 70 by conveying means 66. The toner image transferred onto transfer material S is fixed by fixing device 70, and then transfer material S is taken out onto the upper face of image forming apparatus 1 through vertical conveying pass 80.

EXAMPLE

Next, the embodiments of the present invention will be explained employing examples, but the present invention is not limited thereto.

<Preparation of Resin Particle Dispersion 1>

In a separable flask fitted with a temperature sensor, a condenser, a nitrogen gas-introducing device and a stirrer, 97.0 parts by weight of an aqueous sodium dodecylsulfate solution (active component: 2.6 parts by weight) was dissolved in 1510 parts by weight of ion-exchange water to prepare "aqueous medium 1", and subsequently a mixture containing the following components was added into "aqueous medium 1".

| | |
|---|---|
| Styrene | 213 parts by weight |
| n-butylacrylate | 62 parts by weight |
| Acrylic acid | 7 parts by weight |
| Pentaerythritol tetrastearate | 154 parts by weight |

After an initiator solution containing the following components was added into the above "aqueous medium 1", and the temperature was raised to 82.5° C., polymerization reaction was performed for 2 hours.

| | |
|---|---|
| Aqueous hydrogen peroxide solution (active component: 2.5 parts by weight) | 42 parts by weight |
| Aqueous sodium erythorbate solution (active component: 6.5 parts by weight) | 42 parts by weight |
| n-octylmercaptan | 0.6 parts by weight |
| Next, addition of a monomer mixture containing the following components. | |
| Styrene | 542 parts by weight |
| n-butylacrylate | 157 parts by weight |
| Acrylic acid | 18 parts by weight |

Subsequently, addition of an initiator solution containing the following components.

| | |
|---|---|
| Aqueous hydrogen peroxide solution (active component: 9 parts by weight) | 145 parts by weight |
| Aqueous sodium erythorbate solution (active component: 23.5 parts by weight) | 153 parts by weight |
| n-octylmercaptan | 8.2 parts by weight |

Further, after 48 parts by weight of an aqueous sodium dodecylsulfate solution (active component: 4.8 parts by weight) was added into the resulting, and the temperature was raised to 90° C., polymerization reaction was performed while stirring for one hour to prepare a resin particle dispersion. This was designated as resin particle dispersion 1.

<Preparation of Colorant Dispersion>

An aqueous dispersion was prepared via dispersion in an ion-exchange water in such a way that a colorant dispersion is C.I. pigment red 122 having a solid content of 12.5% by weight as a magenta colorant. This was designated "colorant dispersion".

<<Preparation of Toner>>

<Preparation of toner 1>

In a separable flask fitted with a temperature sensor, a condenser, a nitrogen gas-introducing device and a stirrer, charged were 1700 parts by weight of "resin particle dispersion 1" (in terms of solid content conversion), 2100 parts by weight of ion-exchange water and 250 parts by weight of "colorant dispersion". Further, the pH was adjusted to 10 via addition of an aqueous sodium hydroxide solution (25% by weight), maintaining the temperature at 30° C.

Next, after an aqueous solution, in which 54.3 parts by weight of magnesium chloride hexahydrate was dissolved in 104.3 parts by weight of ion-exchange water, was added, a temperature of this system was raised to 75° C., and coagulation reaction of resin particles with colorant particles was started. Taking a sample at the regular intervals, volume-based median particle diameter ($D_{50}$) and circularity were measured employing a particle size distribution measuring apparatus "COULTER MULTISIZER 3" (produced by Beckman Coulter Co.). When volume-based median particle diameter ($D_{50}$) reached 5.8 μm, 32 parts by weight of foregoing exemplified compound (1-3) was added, and stirring was further continued.

When circularity of the particle reached 0.976, a temperature of the system was cooled to 30° C., and coagulation reaction was terminated to prepare "colored particle 1 dispersion". The resulting "colored particle 1" has a volume-based median diameter ($D_{50}$) of 5.8 μm, and a variation coefficient of 18.8 according to volume-based particle size distribution.

The resulting "colored particle 1 dispersion" was separated by a basket type centrifugal separator Mark III type No. 60×40 manufactured by Matsumoto Kikai Mfg. Co. Ltd. to produce "colored particle 1 wet cake". The wet cake was washed with water until electrical conductivity of the filtrated liquid reached 15 μS/cm. Incidentally, an amount of washing water was consumed 18 times as much as a solid content of "colored particle 1 wet cake". Subsequently, it was moved to "Flash jet dryer" produced by Seishin Enterprise Co., Ltd., and the washed colored particles were dried until the moisture content was reduced by 0.5% by weight, to prepare "colored particle 1". In addition, the air flow during drying treatment was under conditions of 40° C. and 20% RH.

After the drying treatment was terminated, 1% by weight of hydrophobic silica (a number average primary particle diameter of 12 nm and a hydrophobicity degree of 68) and 1% by weight of hydrophobic titanium oxide (a number average primary particle diameter of 80 nm and a hydrophobicity degree of 63) were added into the resulting "colored particle 1", and mixed using "Henschel mixer" (manufactured by Mitsui Miike Co., Ltd.) to prepare "toner 1".

The resulting "toner 1" has the same volume-based median particle diameter ($D_{50}$) and variation coefficient in a volume-based particle size distribution as the foregoing measured values.

<Preparation of Toner 2>

"Toner 2" was prepared similarly to preparation of "toner 1", except that 43.8 parts by weight of disodium salt of exemplified compound (1-3) were added when the volume-based median particle diameter ($D_{50}$) reached 3.1 μm, after coagulation reaction of resin particles with colorant particles was started in preparation of "toner 1".

<Preparation of Toner 3>

"Toner 3" was prepared similarly to preparation of "toner 1", except that 37.6 parts by weight of exemplified compound (2-4) were added when the volume-based median particle diameter ($D_{50}$) reached 8.9 μm, after coagulation reaction of resin particles with colorant particles was started in preparation of "toner 1".

<Preparation of Toner 4>

"Toner 4" was prepared similarly to preparation of "toner 1", except that 32.0 parts by weight of exemplified compound (1-3) were replaced by 43.5 parts by weight of sodium salt of exemplified compound (2-4) in preparation of "toner 1". In addition, the duration consumed in a drying process was the same duration as in preparation of toner 1.

<Preparation of Toner 5>

"Toner 5" was prepared similarly to preparation of "toner 1", except that 32.0 parts by weight of exemplified compound (1-3) were replaced by 36.8 parts by weight of exemplified compound (3-1) in preparation of "toner 1". In addition, the duration consumed in a drying process was the same duration as in preparation of toner 1.

<Preparation of Toner 6>

"Toner 6" was prepared similarly to preparation of "toner 1", except that 32.0 parts by weight of exemplified compound (1-3) were replaced by 43.5 parts by weight of disodium salt of exemplified compound (3-1) in preparation of "toner 1". In addition, the duration consumed in a drying process was the same duration as in preparation of toner 1.

<Preparation of Toner 7>

"Toner 7" was prepared similarly to preparation of "toner 1", except that 32.0 parts by weight of exemplified compound (1-3) were replaced by 26.4 parts by weight of exemplified compound (6-1) in preparation of "toner 1". In addition, the duration consumed in a drying process was the same duration as in preparation of toner 1.

<Preparation of Toner 8>

"Toner 8" was prepared similarly to preparation of "toner 1", except that 32.0 parts by weight of exemplified compound (1-3) were replaced by 39.6 parts by weight of exemplified compound (6-1) in preparation of "toner 1". In addition, the duration consumed in a drying process was the same duration as in preparation of toner 1.

<Preparation of Toner 9>

"Toner 9" was prepared similarly to preparation of "toner 1", except that 32.0 parts by weight of exemplified compound (1-3) were replaced by 52.9 parts by weight of exemplified compound (6-1) in preparation of "toner 1". In addition, the duration consumed in a drying process was the same duration as in preparation of toner 1.

<Preparation of Toner 10>

"Toner 10" was prepared similarly to preparation of "toner 1", except that 32.0 parts by weight of exemplified compound (1-3) were replaced by 35.2 parts by weight of trisodium salt of exemplified compound (6-1) in preparation of "toner 1". In this regard, however, concerning trisodium salt of exemplified compound (6-1), added was an aqueous 30% by weight trisodium salt solution. In addition, the duration consumed in a drying process was the same duration as in preparation of toner 1.

<Preparation of Toner 11>

"Toner 11" was prepared similarly to preparation of "toner 1", except that 32.0 parts by weight of exemplified compound (1-3) were replaced by 52.9 parts by weight of trisodium salt of exemplified compound (6-1) in preparation of "toner 1". In this regard, however, concerning trisodium salt of exemplified compound (6-1), added was an aqueous 30% by weight trisodium salt solution. In addition, the duration consumed in a drying process was the same duration as in preparation of toner 1.

<Preparation of Toner 12>

"Toner 12" was prepared similarly to preparation of "toner 1", except that 32.0 parts by weight of exemplified compound (1-3) were replaced by 70.5 parts by weight of trisodium salt of exemplified compound (6-1) in preparation of "toner 1". In this regard, however, concerning trisodium salt of exemplified compound (6-1), added was an aqueous 30% by weight trisodium salt solution. In addition, the duration consumed in a drying process was the same duration as in preparation of toner 1.

<Preparation of Toner 13>

"Toner 13" was prepared similarly to preparation of "toner 1", except that 32.0 parts by weight of exemplified compound (1-3) were replaced by 38.2 parts by weight of exemplified compound (10-1) in preparation of "toner 1". In this regard, however, concerning trisodium salt of exemplified compound (10-1), added was an aqueous 30% by weight trisodium salt solution. In addition, the duration consumed in a drying process was the same duration as in preparation of toner 1.

<Preparation of Toner 14>

"Toner 14" was prepared similarly to preparation of "toner 1", except that 32.0 parts by weight of exemplified compound (1-3) were replaced by 50.1 parts by weight of trisodium salt of exemplified compound (10-1) in preparation of "toner 1". In this regard, however, concerning trisodium salt of exemplified compound (10-1), added was an aqueous 30% by weight trisodium salt solution. In addition, the duration consumed in a drying process was the same duration as in preparation of toner 1.

<Preparation of Toner 15>

"Toner 15" was prepared similarly to preparation of "toner 1", except that 32.0 parts by weight of exemplified compound (1-3) were replaced by 64.5 parts by weight of exemplified compound (9-2) in preparation of "toner 1". In addition, the duration consumed in a drying process was the same duration as in preparation of toner 1.

<Preparation of Toner 16>

"Toner 16" was prepared similarly to preparation of "toner 1", except that 32.0 parts by weight of exemplified compound (1-3) were replaced by 70.7 parts by weight of tetrasodium salt of exemplified compound (9-2) in preparation of "toner 1". In this regard, however, concerning tetrasodium salt of exemplified compound (9-2), added was an aqueous 30% by weight tetrasodium salt solution. In addition, the duration consumed in a drying process was the same duration as in preparation of toner 1.

<Preparation of Toner 17>

"Toner 17" was prepared similarly to preparation of "toner 1", except that 32.0 parts by weight of exemplified compound (1-3) were replaced by 70.7 parts by weight of exemplified compound (10-8) in preparation of "toner 1". In addition, the duration consumed in a drying process was the same duration as in preparation of toner 1.

<Preparation of Toner 18>

"Toner 18" was prepared similarly to preparation of "toner 1", except that 32.0 parts by weight of exemplified compound (1-3) were replaced by 360.8 parts by weight of sodium chloride in preparation of "toner 1". In this regard, however, added was an aqueous 7.4% by weight sodium chloride solution. In addition, the duration in a drying process was consumed three times as much duration as in preparation of toner 1, but the moisture content was reduced only down to 0.9% by weight.

<Preparation of Toner 19>

In a four-necked flask fitted with a temperature sensor, a condenser and a nitrogen gas-introducing device and a stirrer, charged were 1700 parts by weight of "resin particle dispersion 1", 2100 parts by weight of ion-exchange water and 250 parts by weight of "colorant dispersion", and the system was stirred and homogenized, maintaining the temperature at 30° C. Next, 2.8 parts by weight of an aqueous polyaluminium hydroxide coagulant solution charged into 28 parts by weight of 0.3 M nitric acid was added and homogenized for 5 minutes.

Next, the resulting mixture was heated to a temperature of 52° C., and stirred for 105 minutes to obtain a volume-based median particle diameter ($D_{50}$) of 5.10 μm. At this point, presence of a coarse particle of at least 16 μm was confirmed via measurement of a particle size distribution.

Three parts by weight of exemplified compound (8-4) was added in order to change the pH of the mixture from 2.6 to 7.0, whereby the mixture was stabilized so as not to grow the particle diameter in the mixture.

After stirring was continued for 4 hours, when circularity reached 0.976, temperature was cooled down to 30° C. to terminate the association process. Regarding the washing process and drying process, "toner 19" was prepared similarly to preparation of toner 1.

"Toner 19" was prepared similarly to preparation of "toner 1", except that a polyvalent organic acid of exemplified compound (8-4) was added in "preparation of toner 1" after coagulation (particle growth) was terminated and stabilized.

<Preparation of Toner 20>

"Toner 20" was prepared similarly to preparation of "toner 1", except that 32.0 parts by weight of exemplified compound (1-3) were replaced by 47.8 parts by weight of sodium salt of exemplified compound (2-4). In addition, time consumed for a drying process was the same as in preparation of toner 1.

<Preparation of Toner 21>

"Toner 21" was prepared similarly to preparation of "toner 1", except that 32.0 parts by weight of exemplified compound (1-3) were replaced by 0.5 parts by weight of sodium salt of exemplified compound (2-4).

The volume-based median particle diameter ($D_{50}$), the variation coefficient in volume-based particle size distribution, the content of polyvalent organic acid or salt in toner, and the content of sodium element and the content of divalent or trivalent metal element are shown in Table 1.

TABLE 1

| Toner No. | *1 (μm) | *2 (%) | Content of polyvalent organic acid or salt (ppm) | Sodium element content (ppm) | Divalent or trivalent metal element content (ppm) |
|---|---|---|---|---|---|
| Toner 1 | 5.81 | 18.8 | 220 | 8 | 1110 |
| Toner 2 | 3.10 | 18.5 | 280 | 16 | 992 |
| Toner 3 | 8.90 | 18.5 | 872 | 91 | 1600 |
| Toner 4 | 5.81 | 18.5 | 984 | 99 | 1580 |
| Toner 5 | 5.80 | 16.9 | 70 | 67 | 1550 |
| Toner 6 | 5.80 | 16.9 | 77 | 88 | 1510 |
| Toner 7 | 5.80 | 16.8 | 12 | 5 | 1460 |
| Toner 8 | 5.80 | 16.7 | 23 | 7 | 1410 |
| Toner 9 | 5.80 | 16.6 | 30 | 8 | 1380 |
| Toner 10 | 5.80 | 16.6 | 15 | 11 | 620 |
| Toner 11 | 5.80 | 16.6 | 22 | 19 | 830 |
| Toner 12 | 5.80 | 16.6 | 31 | 28 | 1210 |
| Toner 13 | 5.81 | 17.5 | 80 | 26 | 1010 |
| Toner 14 | 5.81 | 17.5 | 148 | 74 | 960 |
| Toner 15 | 5.80 | 16.4 | 62 | 12 | 840 |
| Toner 16 | 5.80 | 16.4 | 164 | 18 | 620 |
| Toner 17 | 5.81 | 17.2 | 80 | 4 | 640 |
| Toner 18 | 5.82 | 20.1 | 0 | 110 | 1760 |
| Toner 19 | 5.10 | 21.6 | 0 | 2 | 380 |
| Toner 20 | 5.82 | 18.5 | 1082 | 109 | 1575 |
| Toner 21 | 5.82 | 18.6 | 10 | 5 | 590 |

*1: Volume-based median particle diameter ($D_{50}$)
*2: Variation coefficient in volume-based particle size distribution (Non-Magnetic Single Component Developer)

Toners 1-21 prepared above were used as a non-magnetic single component developer.

<<Evaluation>>

<Image Forming Apparatus>

As an image forming apparatus used for evaluation, a color laser printer "magicolor5430DL" (manufactured by Konica Minolta Business Technologies, Inc.) available on the market was modified in such a way that only magenta toner was possible to be output, and the print speed (linear speed) was arranged to be set twice as much as the commercially available setting for evaluation. The reason why the evaluation is made with only magenta toner is that an evaluation mode, in which filming of a developing roller (a problem to be solved by the present invention), particularly, is easily detected (highly visible in the case of generation of filming), can be obtained.

When a remaining amount of toner lessened, the evaluation was continued with no change of the developing roller, after bringing the printer to a stop to add toner into a toner cartridge.

<Evaluation Items>

(Crushability Index)

Crushability strength was evaluated as a crushability index. The value of crushability index is a value obtained by the foregoing measuring method.

In addition, the smaller the value of crushability index is, the less the amount of powder generated via crushability is. This is preferred.

(Filming of Developing Roller)

Printing was conducted on A4 size paper sheet (65 g/m$^2$) at low temperature and low humidity (10° C. and 20% RH). The surface of the developing roller was visually observed every 10000 prints to count the number of paper sheets on which filming was generated, and a level of scattered toner around a developing unit was also visually observed.

In addition, the evaluation of filming of the developing roller was made with the smaller number of paper sheets of either one of "the number of paper sheets on which filming was generated" and "the level of scattered toner".

Evaluation Criteria Filming

A: No filming of a developing roller is observed at the time of 40000 prints.

B: Filming of a developing roller is observed at the time of at least 30000 and less than 40000 prints.

C: Filming of a developing roller is observed at the time of less than 30000 prints.

Evaluation Criteria of Scattered Toner

A: No scattered toner around a developing unit is observed at the time of 60000 prints.

B: Scattered toner around a developing unit is observed at the time of at least 40000 and less than 60000 prints.

C: Scattered toner around a developing unit is observed at the time of less than 40000 prints.

(Image Density Reduction)

Printing of 5000 prints was conducted on A4 size paper sheet (65 g/m$^2$) at low temperature and low humidity (10° C. and 20% RH). The image density reduction was evaluated by measuring the image densities at solid image portions at the start of printing and at the end of printing 5000 prints. The image density was measured employing a reflective densitometer RD-918, manufactured by Macbeth Co., Ltd.

Evaluation Criteria

A: Image density reduction between at the start of printing and at the end of printing 5000 prints is less than 0.01; Excellent.

B: Image density reduction between at the start of printing and at the end of printing 5000 prints is at least 0.01 and less than 0.04; Good.

C: Image density reduction between at the start of printing and at the end of printing 5000 prints is at least 0.04; No good.

Evaluation results are shown in Table 2.

TABLE 2

| | | Evaluation results | | |
|---|---|---|---|---|
| | Toner No. | Crushability index of toner | Filming of developing roller | *1 |
| Example 1 | Toner 1 | 0.07 | B | B |
| Example 2 | Toner 2 | 0.06 | B | B |
| Example 3 | Toner 3 | 0.06 | B | B |
| Example 4 | Toner 4 | 0.06 | B | B |
| Example 5 | Toner 5 | 0.04 | A | B |
| Example 6 | Toner 6 | 0.04 | A | B |
| Example 7 | Toner 7 | 0.04 | A | A |
| Example 8 | Toner 8 | 0.03 | A | A |
| Example 9 | Toner 9 | 0.04 | A | A |
| Example 10 | Toner 10 | 0.02 | A | A |
| Example 11 | Toner 11 | 0.02 | A | A |
| Example 12 | Toner 12 | 0.01 | A | A |
| Example 13 | Toner 13 | 0.02 | A | B |
| Example 14 | Toner 14 | 0.02 | A | B |
| Example 15 | Toner 15 | 0.02 | A | A |
| Example 16 | Toner 16 | 0.02 | A | A |
| Example 17 | Toner 17 | 0.04 | A | B |
| Comparative example 1 | Toner 18 | 0.22 | C | C |
| Comparative example 2 | Toner 19 | 0.15 | C | C |
| Comparative example 3 | Toner 20 | 0.06 | B | C |
| Comparative example 4 | Toner 21 | 0.10 | C | C |

*1: Image density reduction at low temperature and low humidity.

As is clear from the evaluation results in Table 2, it is to be understood that tones 1-17 corresponding to Examples 1-17 have smaller crushability index than in Comparative examples 1-2, exhibiting excellent properties On the contrary, it is also to be understood that Comparative examples 1-4 have produced a problem in any of the evaluation items in comparison to Examples 1-17. It is also to be understood that "Toner 20" of Comparative example 3 exhibits image density reduction largely.

EFFECT OF THE INVENTION

It was possible in the present invention to provide an electrostatic charge image developing toner usable for a downsized color image forming apparatus capable of rapid print preparation with neither an influence on production cost nor use of a specific material as the toner constituent material.

Even though the toner of the present invention is utilized for a downsized image forming apparatus as a non-single component developer used for color image formation, no toner tends to be crushed inside a small developing device undergoing a strong impact constantly. As a result, stable image formation was to be conducted with no occurrence of filming and scattered toner.

Full color images were possible to be formed even when preparation of a conference material at the office and POP advertisement at a print shop had to be rapidly conducted, since toner of the present invention was capable of generating rapid charge rising capability any time soon.

In the present invention, color prints in stable image quality were also able to be provided in large quantities, since a toner image with no variation of image density was acquired even with continuous printing in large quantities. Furthermore, it became possible to provide color prints in stable image quality with no variation of image density caused by an influence on the condition of installation of an image forming apparatus.

What is claimed is:

1. An electrostatic charge image developing toner comprising a resin and a colorant, wherein the electrostatic charge image developing toner contains 12-984 ppm of a polyvalent organic acid or a salt thereof, and the polyvalent organic acid or a salt thereof has a molecular weight of 47-1500.

2. The electrostatic charge image developing toner of claim 1, wherein the polyvalent organic acid is a polycarboxylic acid.

3. The electrostatic charge image developing toner of claim 1, wherein the polyvalent organic acid is an oxo acid.

4. The electrostatic charge image developing toner of claim 2, wherein the polyvalent organic acid is an oxo acid.

5. The electrostatic charge image developing toner of claim 1, wherein the polyvalent organic acid is an amino acid.

6. The electrostatic charge image developing toner of claim 2, wherein the polyvalent organic acid is an amino acid.

7. The electrostatic charge image developing toner of claim 2, wherein the polycarboxylic acid has at least two carboxyl groups and at most 12 carbon atoms in a molecule.

8. The electrostatic charge image developing toner of claim 1, wherein the electrostatic charge image developing toner contains 4-90 ppm of a sodium element and 600-1650 ppm of a divalent or trivalent metal element.

9. The electrostatic charge image developing toner of claim 1, wherein the resin comprises a vinyl polymer.

10. A non-magnetic single component toner comprising the electrostatic charge image developing toner of claim 1.

* * * * *